US005809669A

United States Patent [19]

Hage et al.

[11] Patent Number: 5,809,669

[45] Date of Patent: Sep. 22, 1998

[54] GOLF-CLUB HEAD CLEANING DEVICE

[76] Inventors: Daniel E. Hage, 790 N. Cedar Bloff #2614; Michael J. Zurakowski, 207 E. Cavetton, both of Knoxville, Tenn. 37923

[21] Appl. No.: 733,221

[22] Filed: Oct. 17, 1996

Related U.S. Application Data

[63] Continuation of Ser. No. 418,245, Apr. 6, 1995, abandoned.

[51] Int. Cl.[6] ..... A43B 5/00; A43B 23/00

[52] U.S. Cl. ..... 36/127; 36/136; 36/132; 15/227

[58] Field of Search ..... 36/127, 136, 132, 36/100, 101, 54, 1; 2/160, 161.2, 161.5; 15/227, 210.1, 220.4, 209.1, 244.3

[56] References Cited

U.S. PATENT DOCUMENTS

| | | | |
|---|---|---|---|
| 3,119,191 | 1/1964 | Vitzthum . | |
| 3,588,917 | 6/1971 | Antonious | 2/161 |
| 3,999,311 | 12/1976 | Epstein | 36/100 |
| 4,122,577 | 10/1978 | Catania | 15/160 |
| 4,126,951 | 11/1978 | Antonious | 36/54 |
| 4,130,950 | 12/1978 | Bazzle et al. | 36/127 |
| 4,350,457 | 9/1982 | Carnahan | 401/11 |
| 4,458,432 | 7/1984 | Stempski | 36/132 |
| 4,593,427 | 6/1986 | Ortolivo | 15/227 |
| 4,605,592 | 8/1986 | Paquette et al. | 428/334 |
| 4,621,441 | 11/1986 | Wagner et al. . | |
| 4,697,362 | 10/1987 | Wasserman | 36/136 |
| 4,726,128 | 2/1988 | Lin | 36/132 |
| 4,750,278 | 6/1988 | Cates | 36/72 |
| 4,823,426 | 4/1989 | Bragga | 15/210 R |
| 4,949,417 | 8/1990 | Wertz et al. | 15/104.93 |
| 4,958,447 | 9/1990 | DuPree | 36/101 |
| 4,996,800 | 3/1991 | Mangus | 15/220.4 |

FOREIGN PATENT DOCUMENTS

| | | | |
|---|---|---|---|
| 2171590 | 9/1986 | United Kingdom | 23/30 |

*Primary Examiner*—M. D. Patterson
*Attorney, Agent, or Firm*—Pitts & Brittian, P.C.

[57] ABSTRACT

A golf-club head cleaning device 10including a panel member 15 which is secured by means of an adhesive 25 to the outer surface of a golf shoe 12 while playing golf. The panel member 15 can be constructed of any material, not damaging to golf-club heads, which has a friction producing or roughened surface to facilitate the removal of grass and earth from golf-club heads and is preferably constructed of advanced polyamide fiber 20. The panel member 15 is preferably secured at the side of the upper 35 of golf shoe 12. The panel member 15 should be of a size which will facilitate easy cleaning of golf-club heads. The shape of the panel member 15 will vary depending on the style of the golf shoe 12 to which it is secured.

5 Claims, 2 Drawing Sheets

GOLF-CLUB HEAD CLEANING DEVICE

This is a continuation of application Ser. No. 08/418,245, filed on Apr. 6, 1995, which in part disclosed and claimed subject matter disclosed in our earlier filed application, serial number 08/320,383, filed on Oct. 11, 1994, now abandoned, which was a continuation of our application Ser. No. 08/120,663, filed on Sept. 13, 1993, which is also now abandoned

TECHNICAL FIELD

This invention relates to golf-club head cleaning devices. More specifically, the present invention relates to a device, in the form of a panel that can be secured to a golf shoe, for cleaning the head of a golf club during a round of play.

BACKGROUND ART

In playing the game of golf, the heads of the golf clubs often become coated with grass and earth. With all golf clubs, but most particularly with putters, the presence of grass or earth on the club head interferes with the accuracy of a golfer's shots. Therefore, grass and earth must be removed, periodically and repeatedly during play, from the golf-club heads. In the past, golfers have normally utilized a piece of cloth or their clothing to clean golf-club heads. Utilizing clothing to clean golf-club heads soils and often stains the clothing. Utilizing a piece of cloth to clean golf-club heads requires the golfer to handle a cloth which becomes more soiled with use. The pieces of cloth are also easily lost or misplaced. Therefore, locating and using the cloth can be time consuming and distracting.

U.S. Pat. No. 4,122,577, issued to Catania, relates to golf-club head cleaning devices. Catania discloses a plate worn on a right or left golf shoe which is held by the standard pointed shoe spikes on the soles of golf shoes. The plate, which extends outward from the shoe sole, carries a wiping element for cleaning golf-club heads. The device disclosed by Catania is necessarily limited to use on spiked shoes. As the Catania device extends away from the surface of the shoe, there is also a risk that the device will catch or snag something thereby tripping the wearer or reducing the wearer's mobility in getting into and out of a golf cart. As the Catania device is a rigid member, it can also reduce the flexibility of the shoe to which it is attached. U.S. Pat. No. 4,697,362, issued to Wasserman relates to the application of tabs to footwear. Wasserman discloses the removable application of a tab containing identifying indicia or colors to various components of a shoe for the purpose of identifying product source. U.S. Pat. No. 4,823,426, issued to Bragga relates to a shoe cleaning device. Bragga's device has a inner cushion pad enclosed in a terry cloth fabric cover and has attachment members for removably clasping it around the fastened footwear laces of a shoe. Bragga's device, being covered with terry cloth, is clearly water absorbent. Moreover, Bragga's device is attached to the shoe by means of straps that are positioned beneath the shoes laces and necessarily requires laced shoes.

Accordingly, it is an object of the present invention to provide a golf-club head cleaning device that can be secured to golfer's shoe in a manner that does not interfere with the shoe's flexibility, that does not extend appreciably from the surface of the shoe, that can be easily cleaned and that can be utilized on any substantially enclosed golf shoe.

DISCLOSURE OF THE INVENTION

The golf-club head cleaning device of the present invention includes a panel member that is removably secured to the outer surface of a golf shoe. While the panel is preferably constructed of advanced polyamide fiber, it can be constructed of any material, not damaging to golf-club heads, which has a friction producing or roughened surface to facilitate the removal of grass and earth from golf-club heads. The panel in the preferred embodiment is secured to the side of the upper of the shoe on the outer surface of the shoe. The panel is detachably secured to the shoe's upper by various conventional methods, but preferably is secured to the shoe by means of an adhesive, such as NORTON ADHESIVE #V1331 or STIK-II 2257, with a foam core that prevents the adhesive from wicking into the shoe. The panel is of a size and shape that will facilitate easy cleaning of golf-club heads, the particular size and shape varying depending upon the size and style of the golfer's shoe.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
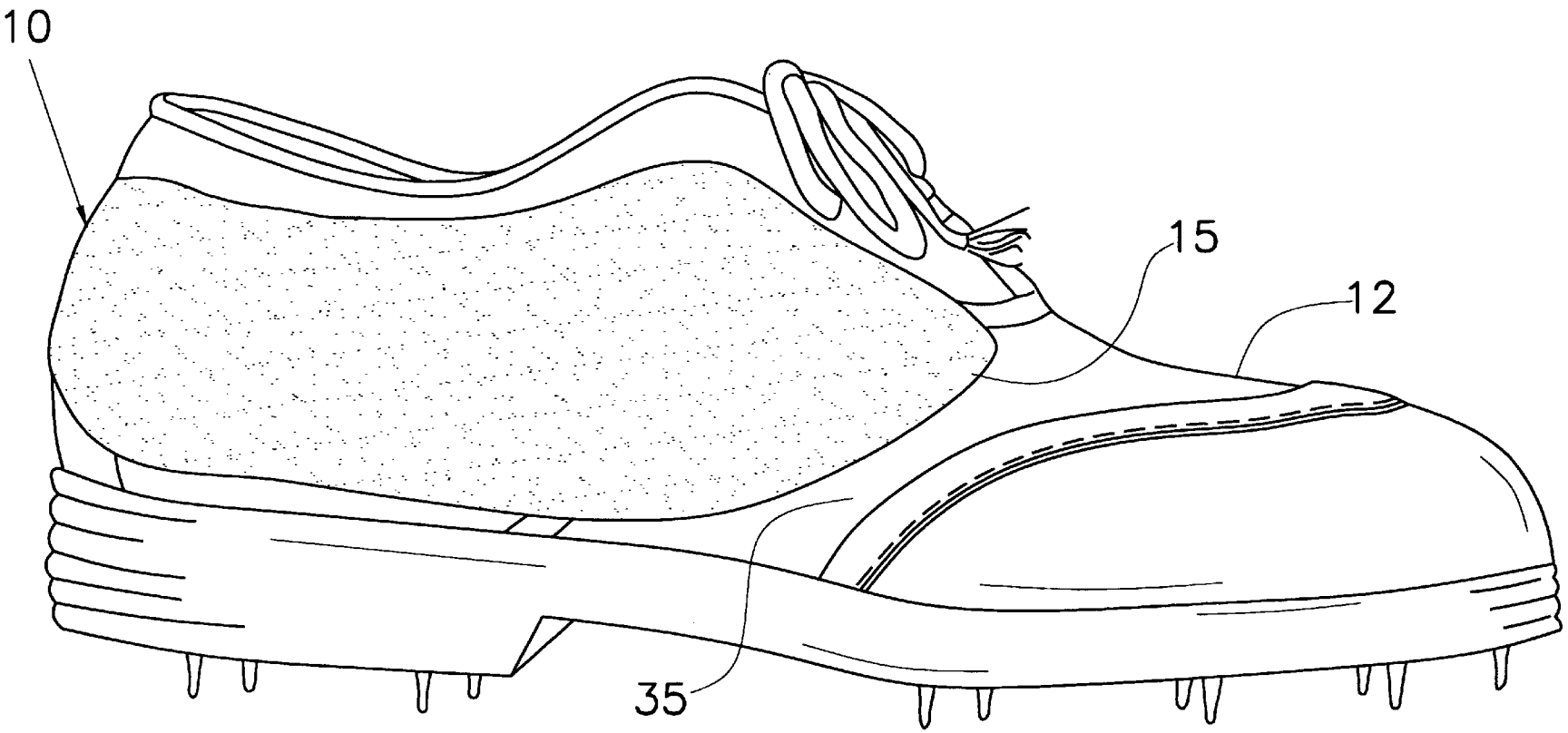
FIG. 1 illustrates a side elevation view of the golf-club head cleaning device of the present invention secured to a golfer's shoe.
Figure 2:
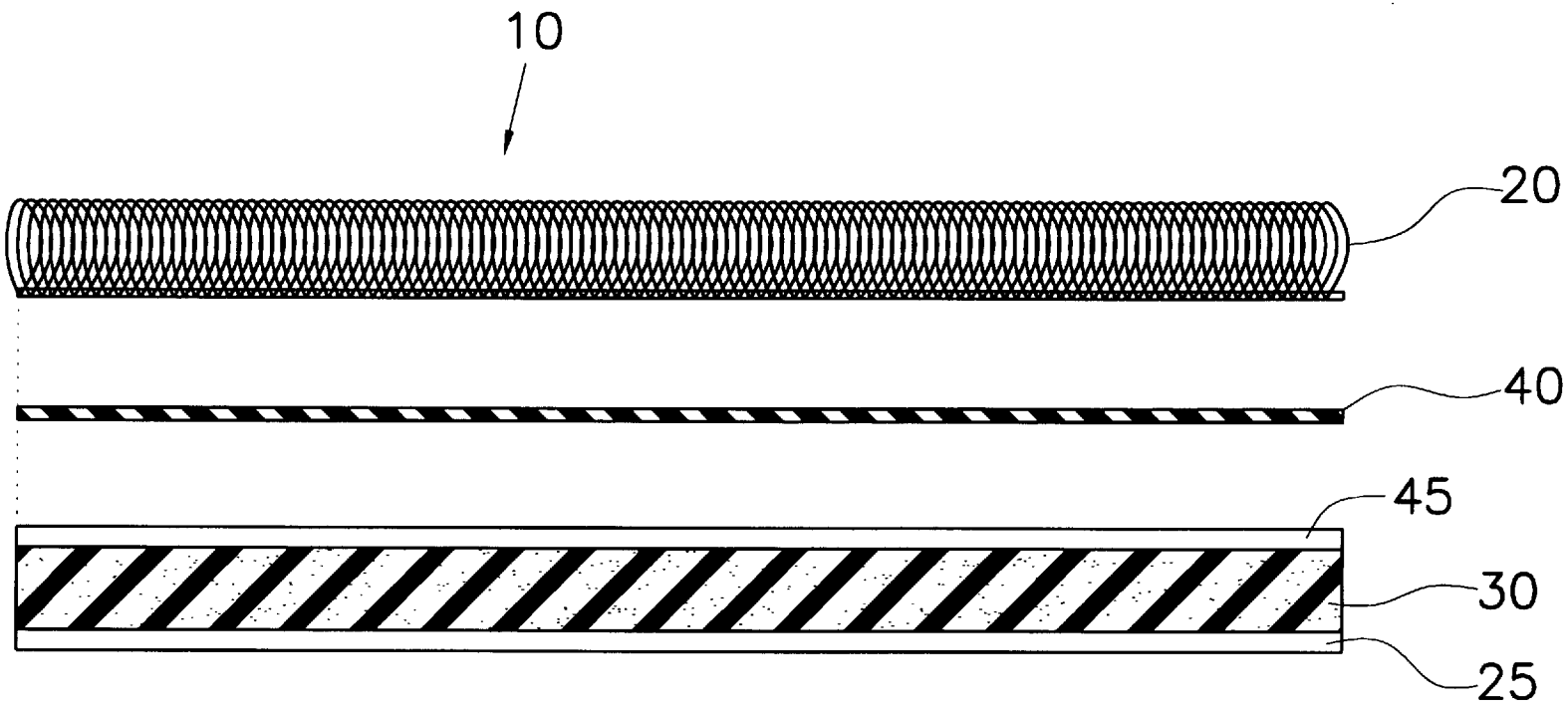
FIG. 2 illustrates an exploded cross-sectional view (not to scale) of the golf-club head cleaning device of the present invention.

A golf-club head cleaning device constructed in accordance with the present invention is illustrated generally as 10 in the figures. Golf-club head cleaning device 10 consists of a panel member 15 preferably constructed of advanced polyamide fiber 20 seen in FIG. 2. Those skilled in the art will recognize that panel member 15 can be constructed of any durable, moisture resistant material, not damaging to golf-club heads, which has a friction producing or roughened surface to facilitate the removal of grass and earth from golf-club heads. In the preferred embodiment, advanced polyamide fiber 20 has a short, stiff nap that allows efficient cleaning of the golf-club head (not shown) and prevents grass clippings, dirt, etc, from becoming matted within advanced polyamide fiber 20. Panel member 15 is secured to golf shoe 12 by means of a layer of adhesive 25. In the preferred embodiment, an adhesive such as NORTON ADHESIVE #V1331 or STIK-II 2257 is utilized. A urethane foam core 30 is interposed between advanced polyamide fiber 20 and adhesive 25. Urethane foam core 30 prevents adhesive 25 from wicking into golf shoe 12, thus preventing damage to golf shoe 12 as a result of the adhesive 25. Further, in the preferred embodiment, a moisture resistant urethane coating 40 is interposed between advanced polyamide fiber 20 and urethane foam core 30 in order to provide a moisture barrier between advanced polyamide fiber 20 and adhesive 25 to insure adhesion and to prevent separation in moist conditions. In this regard, urethane coating 40 is sprayed onto the back of advanced polyamide fiber 20, an additional layer of adhesive 45 is interposed between urethane foam core 30 and urethane coating 40 to provide adhesion between the urethane coated advanced polyamide fiber 20 and the urethane foam core 30. In the preferred embodiment, adhesive 25 allows panel member 15 to be detachably secured to golf shoe 12.

Panel member 15 is of a size which will facilitate easy cleaning of golf-club heads. The shape of panel member 15 will vary depending on the style of the golf shoe 12 to which it is to be secured, and further, on the location on the golf shoe 12 at which it is secured. While those skilled in the art will recognize that panel member 15 can be secured at various locations on the upper 35 of golf shoe 12, in the preferred embodiment, panel member 15 is of a size and shape that substantially conforms to the side of upper 35.

Golf-club head cleaning device 10 is utilized by wiping the head of the club (not shown) across panel member 15 secured to upper 35 of golf shoe 12. This allows a golfer (not shown) to clean the golf-club head without releasing his/her grip on the club or substantially altering his/her stance. Of course, the method of using the device will vary depending upon the location of the panel member 15.

From the foregoing description, it will be recognized by those skilled in the art that a golf-club head cleaning device offering advantages over the prior art has been provided. Specifically, the present invention eliminates the need to carry a cleaning cloth while golfing. It also provides a device for cleaning golf-club heads which can be secured to the surface, and preferably the upper, of any substantially enclosed shoe. It further provides a device for cleaning golf-club heads which does not extend appreciably from the surface of the shoe, eliminating the risk that the device will catch or snag something thereby tripping the golfer or reducing the golfer's mobility in getting into and out of the golf cart. It further provides a device for cleaning golf-club heads which does not interfere with the flexibility of the shoe to which it is secured.

While a preferred embodiment has been shown and described, it will be understood that it is not intended to limit the disclosure, but rather it is intended to cover all modifications and alternate methods falling within the spirit and the scope of the invention as defined in the appended claims and their equivalents. Having thus described the aforementioned invention,

We claim:

1. A golf-club head cleaning device adapted to be mounted upon a golf shoe having an upper with first and second sides, said golf-club head cleaning device comprising:

a panel member constructed of a polyamide fiber, said panel member having a friction producing surface wherein removal of grass and earth from a golf-club head is facilitated, and further wherein said panel member is adapted to be carried by one of a first side and a second side of an upper of a golf shoe;

an adhesive for securing said panel member to the upper of the golf shoe;

a moisture resistant urethane barrier applied to a bottom surface of said panel member and interposed between said panel member and said adhesive for preventing moisture from contacting said adhesive. thereby preventing degradation of said adhesive from moisture: and a foam layer interposed between said moisture resistant urethane barrier and said adhesive, said foam layer being provided to induce wicking of said adhesive therein and for preventing wicking of said adhesive into the golf shoe.

2. The golf-club cleaning device of claim 1 wherein said adhesive is a non-permanent adhesive to allow for selected removal of said panel member from the upper of the golf shoe.

3. A golf-club head cleaning device adapted to be mounted upon a golf shoe having an upper with first and second sides, said golf-club head cleaning device comprising:

a panel member constructed of a moisture resistant polyamide fiber, said panel member having a friction producing surface wherein removal of grass and earth from a golf-club head is facilitated, and further wherein said panel member is adapted to be carried by and substantially cover one of a first side and a second side of an upper of a golf shoe;

an adhesive for securing said panel member to the upper of the golf shoe;

a moisture resistant urethane barrier applied to a bottom surface of said panel member and interposed between said panel member and said adhesive for preventing moisture from contacting said adhesive. thereby preventing degradation of said adhesive from moisture: and a foam layer interposed between said moisture resistant urethane barrier and said adhesive, said foam layer being provided to induce wicking of said adhesive therein and for preventing wicking of said adhesive into the golf shoe.

4. The golf-club cleaning device of claim 3 wherein said adhesive is a non-permanent adhesive to allow for selected removal of said panel member from the upper of the golf shoe.

5. A golf-club head cleaning device adapted to be mounted upon a golf shoe having an upper with first and second sides, said golf-club head cleaning device comprising:

a panel member adapted to be carried by and substantially cover one of a first side and a second side of an upper of a golf shoe, said panel member being constructed of an advanced polyamide fiber material, said panel member having a friction producing surface wherein removal of grass and earth from a golf-club head is facilitated;

an adhesive for releasably securing said panel member to one of the first and second sides of the upper of the golf shoe;

a moisture resistant urethane barrier applied to a bottom surface of said panel member and interposed between said panel member and said adhesive for preventing moisture from contacting said adhesive. thereby preventing degradation of said adhesive from moisture: and a foam layer interposed between said moisture resistant urethane barrier and said adhesive, said foam layer being provided to induce wicking of said adhesive therein and for preventing wicking of said adhesive into the golf shoe.

* * * * *